US006824084B2

(12) United States Patent
Maier et al.

(10) Patent No.: US 6,824,084 B2
(45) Date of Patent: Nov. 30, 2004

(54) FUEL INJECTION VALVE

(75) Inventors: Martin Maier, Moeglingen (DE); Guenther Hohl, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 120 days.

(21) Appl. No.: 10/089,584

(22) PCT Filed: Jul. 18, 2001

(86) PCT No.: PCT/DE01/02700

§ 371 (c)(1),
(2), (4) Date: Jul. 29, 2002

(87) PCT Pub. No.: WO02/10584

PCT Pub. Date: Feb. 7, 2002

(65) Prior Publication Data

US 2003/0047626 A1 Mar. 13, 2003

(30) Foreign Application Priority Data

Jul. 28, 2000 (DE) ..... 100 36 811

(51) Int. Cl.[7] ..... B05B 1/30

(52) U.S. Cl. ..... 239/585.1; 239/585.4; 239/585.5; 239/900; 239/533.11

(58) Field of Search ..... 239/585.1, 585.4, 239/585.5, 533.11, 900

(56) References Cited

U.S. PATENT DOCUMENTS

| | | | | | |
|---|---|---|---|---|---|
| 2,651,744 | A | * | 9/1953 | Acklin et al. | 335/248 |
| 4,749,892 | A | | 6/1988 | Mesenich | |
| 4,844,339 | A | * | 7/1989 | Sayer et al. | 239/5 |
| 4,984,549 | A | | 1/1991 | Mesenich | |
| RE34,591 | E | * | 4/1994 | Yoshida et al. | 239/96 |
| 5,299,776 | A | | 4/1994 | Brinn, Jr. et al. | |
| 5,661,895 | A | * | 9/1997 | Irgens | 29/602.1 |

FOREIGN PATENT DOCUMENTS

| | | |
|---|---|---|
| DE | 33 14 899 | 10/1984 |
| DE | 198 49 210 | 4/2001 |

* cited by examiner

*Primary Examiner*—Dinh Q. Nguyen
(74) *Attorney, Agent, or Firm*—Kenyon & Kenyon

(57) ABSTRACT

A fuel injector (1) for fuel injection systems of internal combustion engines has a solenoid (10), a valve needle (3) pressed in the closing direction by a return spring (23) to activate a valve closing member (4), which together with a valve seat surface (5) forms a sealing seat, and an armature (20) in friction-locking connection with a valve needle (3). A first guide sleeve (35) and a second guide sleeve (36) are connected to the valve needle (3). The armature (20) has radial play with respect to the valve needle (3) as a result of the central opening (34), the diameter of which is greater than the diameter of the valve needle (3).

15 Claims, 2 Drawing Sheets

FUEL INJECTION VALVE

BACKGROUND INFORMATION

Figure 1:
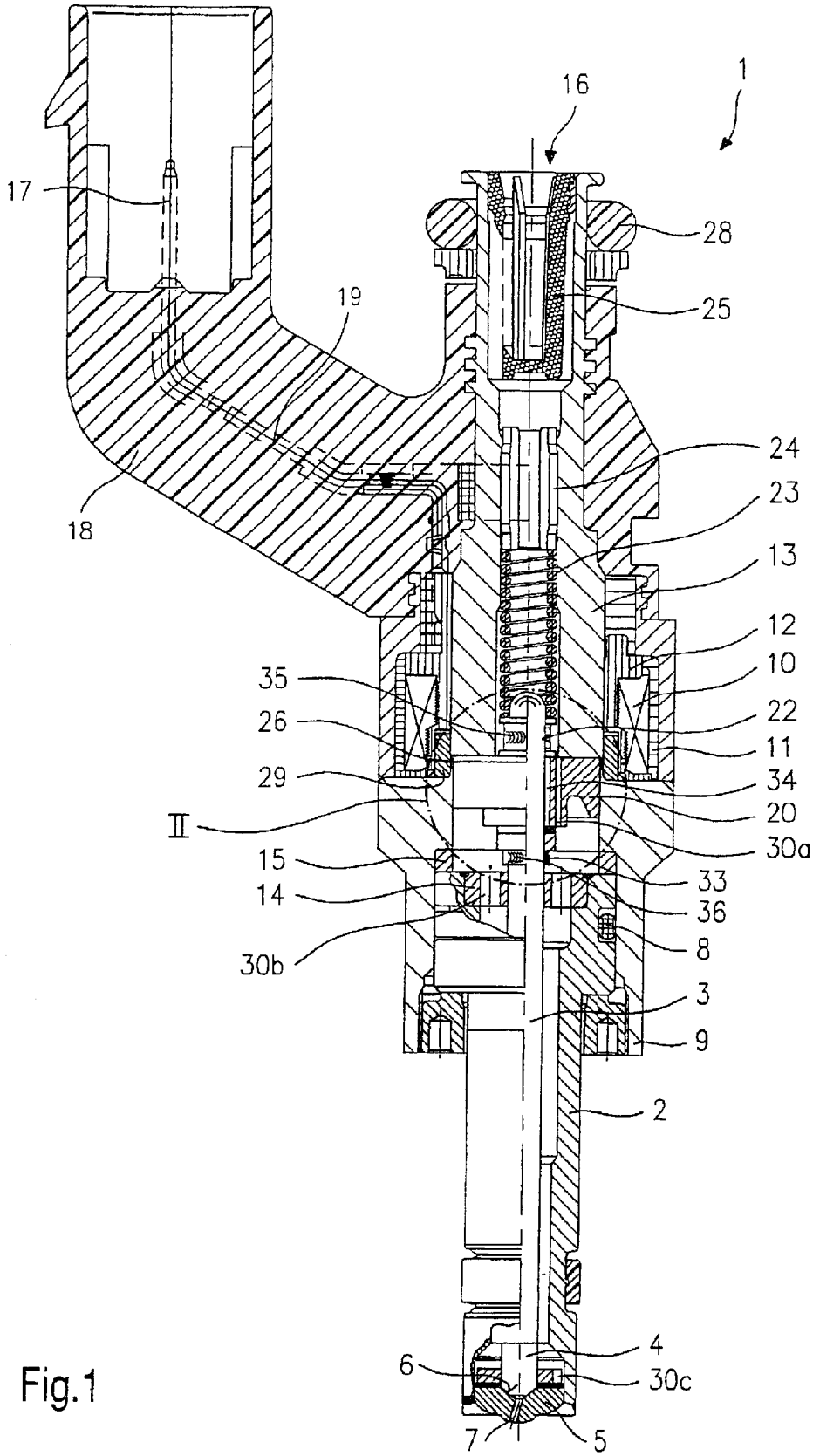

The invention is based on a fuel injector according to the definition of the species of the main claim.

An electromagnetically operable fuel injector is already known from German Laid-Open Patent DE-OS 33 14 899 in which for the purposes of electromagnetic activation an armature acts together with an electrically excitable solenoid and the stroke of the armature is transmitted by way of a valve needle to a valve closing member. The valve closing member works together with a valve seat. The armature is not rigidly attached to the valve needle, but is arranged with axial movement relative to the valve needle. A first return spring exerts pressure on the valve needle in the closing direction and thus holds the fuel injector closed when the solenoid is non-current-bearing and thus not excited. The armature is pressed by a second return spring in the stroke direction such that in its idle position the armature is touching a first stop provided on the valve needle. When the solenoid is excited, the armature is pulled in the stroke direction and by way of the first stop takes the valve needle with it. When the current exciting the solenoid is switched off, the valve needle is accelerated to its closed position by the first return spring, and brings the armature with it by the stop described. As soon as the valve closing member comes into contact with the valve seat, the closing movement of the valve needle is abruptly halted. The movement of the armature, which is not rigidly connected to the valve needle, continues against the stroke direction and is halted by the second return spring, in other words the armature follows through against the second return spring which has a much lower spring constant than the first return spring. Finally, the second return spring accelerates the armature back in the stroke direction.

One disadvantage with the fuel injector known from German Laid-Open Patent DE-OS 33 14 899 is the incomplete elimination of bounce, and on the other hand the arrangement of the armature and valve needle also makes it possible for the latter to tilt or stick as a result of center offset between the valve needle and the armature. This defect is intensified by manufacturing errors in the individual components of the fuel injector, leading to malfunctions of the injector.

In this connection it has also been suggested in U.S. Pat. No. 5,295,776 that the armature should not be connected rigidly to the valve needle, but that a certain axial play in the armature relative to the valve needle should be permitted.

The fuel injector shown in U.S. Pat. No. 5,299,776, however, is equipped with a flat armature, which is not guided within the injector housing but moves freely along the internal pole of the solenoid. In addition, the valve needle has only one guide sleeve, upon which the return spring is supported. A lower guide function is provided by a guide unit which is connected to the injector housing, with this guide unit surrounding the valve needle but not being connected to it in a friction locking manner.

The particular disadvantage of this arrangement lies in the restriction of the degree of freedom in the movement of the valve needle through the guide sleeve joined with the injector housing and thus in the danger of the valve needle tilting. Countering this disadvantage requires components that are manufactured extremely accurately, and these are characterized by high cost and very complex manufacture.

ADVANTAGES OF THE INVENTION

The fuel injector according to the present invention with the distinguishing characteristics of claim 1 has the advantage relative to the related art on the one hand that the radial and axial play of the valve needle brought about by the two guide sleeves and by the central opening in the armature provide so much freedom of movement that tilting is impossible, and on the other that the individual components of the fuel injector can be manufactured with a low degree of complexity, and low production costs, for example by deep drawing, since the design according to the present invention presents a very high tolerance for manufacturing errors in the components.

By the further measures listed in the dependent claims, advantageous further developments of the fuel injector described in the main claim are possible.

Also advantageous is the wedge-shaped or spherical design of the guide sleeves, and the corresponding elevations in the faces of the armature, which compensate for angular misplacements of the valve needle relative to the longitudinal axis of the fuel injector.

In addition, the symmetrical design, i.e. the rotatable mounting of the valve needle in the sealing seat, is advantageous, since this means that even in the event of major center offsets the valve needle can always align itself optimally.

Through the gaps between the guide sleeves and the armature, in addition, a slight pre-acceleration of the valve needle can be achieved, before the armature lifts the valve needle off the sealing seat. By this means the opening times or the amounts of fuel metered can be improved.

DRAWING

Exemplary embodiments of the invention are shown in simplified form in the drawing, and explained in greater detail in the following description.

Figure 2:
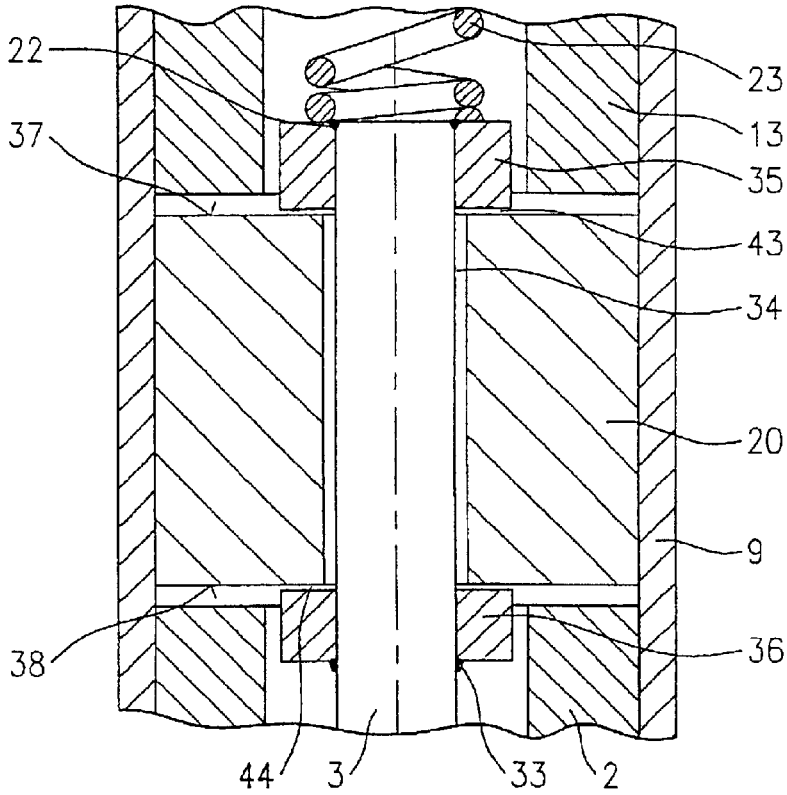
Figure 3:
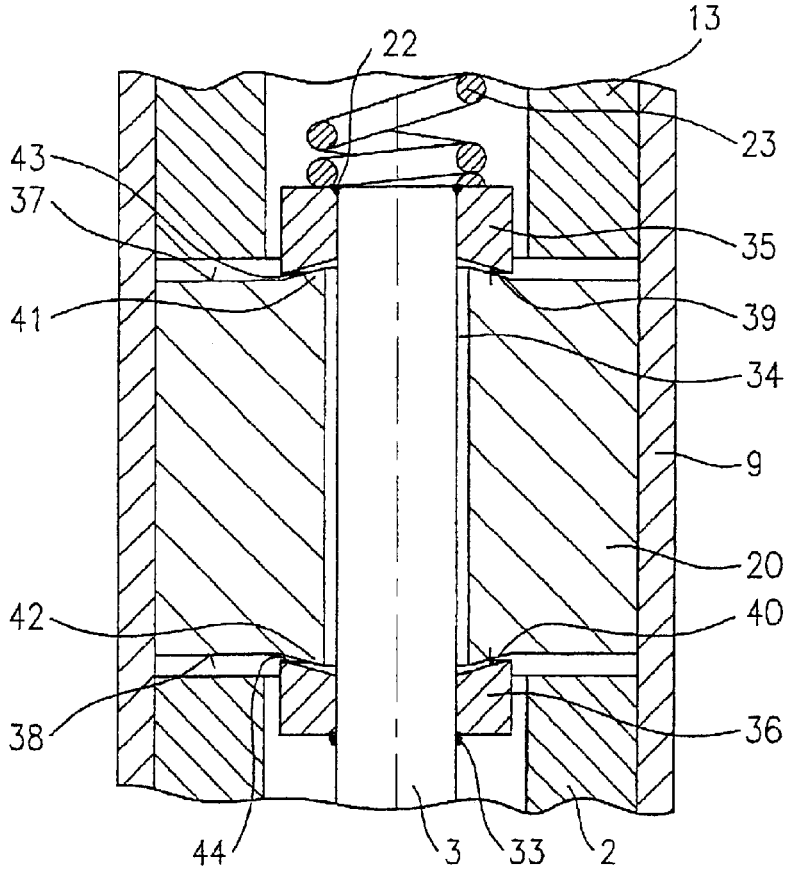

FIG. 1 shows a schematic cross-section through a first exemplary embodiment of a fuel injector according to the present invention, FIG. 2 shows an enlarged schematic cross-section through the fuel injector according to the invention shown in FIG. 1 in the area marked as II in FIG. 1, and FIG. 3 shows an enlarged schematic cross-section through a second exemplary embodiment of a fuel injector according to the invention shown in the area marked as II in FIG. 1.

DESCRIPTION OF THE EXEMPLARY EMBODIMENTS

A fuel injector 1 is constructed in the form of a fuel injector for fuel injection systems on spark-ignition internal combustion engines, in which the fuel-air mixture is compressed. Fuel injector 1 is particularly suitable for direct injection of fuel into a combustion chamber, not shown, of an internal combustion engine.

Fuel injector 1 is composed of a nozzle body 2 into which a valve needle 3 is guided. Valve needle 3 acts upon a valve closing member 4, which acts together with a valve seat surface 6 situated on a valve seat body 5 to compose a sealing seat. In fuel injector 1 in the exemplary embodiment the opening action is inwards, and fuel injector 1 has a spray orifice 7.

Valve needle 3 is rotatably mounted in the sealing seat in order to permit simple guidance of the needle. This has no impact on the imparting of swirl by fuel injector 1, since valve needle 3 is symmetrical around its axis of rotation.

Nozzle body 2 is sealed against external pole 9 of a solenoid 10 by a seal 8. Solenoid 10 is encapsulated in a solenoid housing 11 and wound around a bobbin 12, which is touching internal pole 13 of solenoid 10. Internal pole 13 and external pole 9 are separated from one another by a gap 26 and supported on a connecting member 29. Solenoid 10 is excited through a wire 19 by an electrical current which may be supplied via an electrical plug contact 17. Plug contact 17 is surrounded by a plastic sheath 18 which may be sprayed onto internal pole 13.

Valve needle 3 is guided in a valve needle guide 14, which is disk-shaped. A matched setting disk 15 is used to adjust the stroke setting. An armature 20 is located on the other side of setting disk 15. The armature is in friction-locking connection with valve needle 3, through first guide sleeve 35, and valve needle 3 in turn is connected by a weld seam 22 to first guide sleeve 35. Supported on first guide sleeve 35 is a return spring 23, which in the present design of fuel injector 1 is pre-tensioned by a sleeve 24. A second guide sleeve 36, which is connected to valve needle 3 by way of a weld seam 33, acts as the lower armature stop.

Armature 20 has a central opening 34, through which valve needle 3 protrudes. The radial diameter of central opening 34 is larger than the diameter of valve needle 3, with the result that armature 20 has radial play relative to valve needle 3. This measure, in conjunction with guide sleeves 35 and 36, ensures that valve needle 3 cannot become tilted or stuck.

A detailed description of the area identified as II in FIG. 1 between guide sleeves 35 and 36 is explained more fully in the description covering FIGS. 2 and 3.

Fuel ducts 30*a* to 30*c* run in valve needle guide 14, in armature 20 and on valve seat body 5, bringing the fuel, which is supplied via a central fuel feed 16 and is filtered through a filter element 25, to spray orifice 7. Fuel injector 1 is sealed off by a seal 28 with respect to a cylinder head not further shown or with respect to a fuel distribution line.

In the idle state of fuel injector 1, valve needle 3 is pressed by return spring 23 via first guide sleeve 35 against the stroke direction such that valve closing member 4 is held in sealing contact at valve seat 6. When solenoid 10 is excited, it creates a magnetic field that first pulls armature 20, which is freely movable between guide sleeves 35 and 36, towards first guide sleeve 35 and then moves armature 20 with valve needle 3 and first guide sleeve 35 in the stroke direction against the spring force of return spring 23. In this operation, valve needle 3 takes second guide sleeve 36 with it, guide sleeve 36 being welded to valve needle 3, also in the stroke direction. Valve closing member 4, which is acted on by valve needle 3, lifts off valve seat surface 6 and fuel is sprayed out through spray orifice 7.

When the solenoid current is switched off, after sufficient decay of the magnetic field armature 20 drops away from internal pole 13 in reaction to the pressure of return spring 23, as a result of which the unit composed of valve needle 3, stop sleeves 35 and 36 and armature 20 moves against the stroke direction. As a result, valve closing member 4 settles onto valve seat surface 6 and fuel injector 1 is closed.

FIG. 2 shows the area identified as II in FIG. 1, in a partial and highly schematized representation.

Armature 20 is situated between first guide sleeve 35, upon which return spring 23 is supported, and second guide sleeve 36. By central opening 34 in armature 20, the diameter of which is selected to be slightly greater than the diameter of valve needle 3 protruding through armature 20, radial play for armature 20 is ensured. Since between first face 37 of armature 20 and first guide sleeve 35 there is a first gap 43, and between second face 38 of armature 20 and second guide sleeve 36 there is a second gap 44, slight axial play is also present. Armature 20 is accurately and precisely guided only by external pole 9 of fuel injector 1, external pole 9 in the present first exemplary embodiment being sleeve-shaped. The sleeve-shaped component identified by 9 may also be a non-magnetic thin-walled sleeve which is a part of the injector housing.

Guide sleeves 35 and 36, for their part, are guided in internal pole 13 and in nozzle body 2 of fuel injector 1, in each case with slight play. Guide sleeves 35 and 36 are rigidly connected to valve needle 3, preferably by welding. This ensures on the one hand that the rotational symmetry of valve needle 3 is maintained and also ensures problem-free guidance of valve needle 3 and/or armature 20 even in the event of serious center offset or major manufacturing errors in the components used.

Once the current exciting solenoid 10 is switched on, after sufficient creation of the magnetic field, armature 20 is attracted to internal pole 9. In this operation, armature 20 brings valve needle 3 with it, via first guide sleeve 35, against the force of return spring 23, and in consequence fuel injector 1 is opened. Since first gap 43 is between first guide sleeve 35 and armature 20, armature 20 is initially pre-accelerated by the magnetic field, before the magnetic field has to exert stroke force in drawing armature 20, against the force of return spring 23. In consequence, in addition to guaranteeing that armature 20 will move freely or that valve needle 3 will operate without tilting, the opening times of fuel injector 1 can also be improved.

Similarly, after the solenoid current is switched off, armature 20 is initially pressed away from internal pole 13 by return spring 23 and pre-accelerated via the stroke of second gap 44, before armature 20 takes valve needle 3 with it by second guide sleeve 36 and fuel injector 1 is closed. As a result, in addition to guaranteeing that armature 20 will move freely or that valve needle 3 will operate without tilting, the closing times of fuel injector 1 can also be improved. Overall, these measures also improve the accuracy of the fuel metering.

FIG. 3 shows a second exemplary embodiment of fuel injector 1 according to the invention, from the same view as in FIG. 2.

For further improvement of the guidance of free armature 20, in the present second exemplary embodiment surfaces 39 and 40 of guide sleeves 35 and 35 facing faces 37 and 38 of armature 20 are formed in a wedge or cone shape. Elevations 41 and 42 act as the corresponding abutment surfaces for wedge-shaped surfaces 39 and 40 of guide sleeves 35 and 36, elevations 41 and 42 being formed in rotational symmetry with faces 37 and 38 of armature 20 and, for example, they can be formed as a truncated cone, a crown or a spherical cap.

Elevations 41 and 42 formed in this way are keyed together with wedge-shaped surfaces 39 and 40 and thus ensure more precise guidance of valve needle 3 in guide sleeves 35 and 36, without restricting the free movement of armature 20 or the rotational symmetry of valve needle 3.

Since the total axial extent of gap 43, 44 is smaller than the height of the keyed connections, armature 20 cannot escape from the hollows in wedge-shaped surfaces 39 and 40 of guide sleeves 35 and 36. In consequence, valve needle 3 cannot tilt or stick.

The invention is not restricted to the exemplary embodiments represented and can also be used for a large number of other fuel injectors, and in particular also for fuel injectors in which the opening action is outwards.

What is claimed is:

1. A fuel injector for fuel injection systems of internal combustion engines, comprising:

a solenoid;

a valve closing member;

a valve needle adapted to be acted upon in a closing direction by a return spring to actuate the valve closing member, which, together with a valve seat surface, forms a sealing seat;

an armature connected to the valve needle in a non-friction-locked manner;

a first guide sleeve connected to the valve needle; and a second guide sleeve, wherein the valve needle is connected to the second guide sleeve in a friction-locked manner;

wherein the armature is situated between the first guide sleeve and the second guide sleeve such that it can move freely in an axial direction;

wherein the armature has a central opening whose diameter is greater than the diameter of the valve needle; and wherein the armature has radial play with respect to the valve needle.

2. The fuel injector according to claim 1, wherein the first guide sleeve is situated on a supply-side face of the armature, and the second guide sleeve is situated on a discharge-side face of the armature.

3. The fuel injector according to claim 1, wherein the valve needle protrudes through the armature via the central opening.

4. A fuel injector for fuel injection systems of internal combustion engines, comprising:

a solenoid;

a valve closing member;

a valve needle adapted to be acted upon in a closing direction by a return spring to actuate the valve closing member, which, together with a valve seat surface, forms a sealing seat;

an armature connected to the valve needle in a non-friction-locked manner;

a first guide sleeve connected to the valve needle; and a second guide sleeve;

wherein the valve needle is connected to the second guide sleeve in a friction-locked manner;

wherein the armature is situated between the first guide sleeve and the second guide sleeve such that it can move freely in an axial direction;

wherein the armature has a central opening whose diameter is greater than the diameter of the valve needle;

wherein the armature has radial play with respect to the valve needle; and wherein the first guide sleeve and the second guide sleeve are welded to the valve needle.

5. A fuel injector a for fuel injection systems of internal combustion engines, comprising:

a solenoid;

a valve closing member;

a valve needle adapted to be acted upon in a closing direction by a return spring to actuate the valve closing member, which, together with a valve seat surface, forms a sealing seat;

an armature connected to the valve needle in a non-friction-locked manner;

a first guide sleeve connected to the valve needle; and a second guide sleeve;

wherein the valve needle is connected to the second guide sleeve in a friction-locked manner;

wherein the armature is situated between the first guide sleeve and the second guide sleeve such that it can move freely in an axial direction;

wherein the armature has a central opening whose diameter is greater than the diameter of the valve needle;

wherein the armature has radial play with respect to the valve needle; and wherein the return spring is supported on the first guide sleeve.

6. A fuel injector for fuel injection systems of internal combustion engines, comprising:

a solenoid;

a valve closing member;

a valve needle adapted to be acted upon in a closing direction by a return spring to actuate the valve closing member, which, together with a valve seat surface, forms a sealing seat;

an armature connected to the valve needle in a non-friction-locked manner;

a first guide sleeve connected to the valve needle; and a second guide sleeve;

wherein the valve needle is connected to the second guide sleeve in a friction-locked manner;

wherein the armature is situated between the first guide sleeve and the second guide sleeve such that it can move freely in an axial direction;

wherein the armature has a central opening whose diameter is greater than the diameter of the valve needle;

wherein the armature has radial play with respect to the valve needle; and wherein the valve needle is rotationally mounted in the sealing seat.

7. The fuel injector according to claim 6, wherein the valve needle is axially symmetric.

8. A fuel injector for fuel injection systems of internal combustion engines, comprising:

a solenoid;

a valve closing member;

a valve needle adapted to be acted upon in a closing direction by a return spring to actuate the valve closing member, which, together with a valve seat surface, forms a sealing seat;

an armature connected to the valve needle in a non-friction-locked manner;

a first guide sleeve connected to the valve needle; and a second guide sleeve;

wherein the valve needle is connected to the second guide sleeve in a friction-locked manner;

wherein the armature is situated between the first guide sleeve and the second guide sleeve such that it can move freely in an axial direction;

wherein the armature has a central opening whose diameter is greater than the diameter of the valve needle;

wherein the armature has radial play with respect to the valve needle;

wherein the first guide sleeve is situated on a supply-side face of the armature, and the second guide sleeve is situated on a discharge-side face of the armature; and wherein a first gap exists between the supply-side face of the armature and the first guide sleeve.

9. The fuel injector according to claim 8, wherein a second gap exists between the discharge-side face of the armature and the second guide sleeve.

10. A fuel injector for fuel injection systems of internal combustion engines, comprising:

a solenoid;

a valve closing member;

a valve needle adapted to be acted upon in a closing direction by a return spring to actuate the valve closing member, which, together with a valve seat surface, forms a sealing seat;

an armature connected to the valve needle in a non-friction-locked manner;

a first guide sleeve connected to the valve needle; and a second guide sleeve;

wherein the valve needle is connected to the second guide sleeve in a friction-locked manner;

wherein the armature is situated between the first guide sleeve and the second guide sleeve such that it can move freely in an axial direction;

wherein the armature has a central opening whose diameter is greater than the diameter of the valve needle;

wherein the armature has radial play with respect to the valve needle; and wherein the guide sleeves each have a wedge-shaped surface.

11. The fuel injector according to claim 10, wherein the wedge-shaped surfaces face the armature.

12. The fuel injector according to claim 11, wherein a first wedge-shaped elevation on the supply-side face of the armature matches the wedge-shaped surface of the first guide sleeve.

13. The fuel injector according to claim 11, wherein a second wedge-shaped elevation on the discharge-side face of the armature matches the wedge-shaped surface of the second guide sleeve.

14. The fuel injector according to claim 11, wherein the armature has elevations which are one of a crown and a spherical cap.

15. A fuel injector for fuel injection systems of internal combustion engines, comprising:

a solenoid;

a valve closing member;

a valve needle adapted to be acted upon in a closing direction by a return spring to actuate the valve closing member, which, together with a valve seat surface, forms a sealing seat;

an armature connected to the valve needle in a non-friction-locked manner;

a first guide sleeve connected to the valve needle; and a second guide sleeve for the armature, wherein the valve needle is connected to the second guide sleeve in a friction-locked manner;

wherein the armature situated between the first guide sleeve and the second guide sleeve such that it can move freely in an axial direction as limited by the first guide sleeve and the second guide sleeve;

wherein the armature has a central opening whose diameter is greater than the diameter of the valve needle; and wherein the armature has radial play with respect to the valve needle.

* * * * *

UNITED STATES PATENT AND TRADEMARK OFFICE

CERTIFICATE OF CORRECTION

PATENT NO. : 6,824,084 B2
APPLICATION NO. : 10/089584
DATED : November 30, 2004
INVENTOR(S) : Martin Maier et al.

It is certified that error appears in the above-identified patent and that said Letters Patent is hereby corrected as shown below:

On the title page, item (57) Abstract, line 1, delete "(1)"

On the title page, item (57) Abstract, line 2, change "solenoid (10), a valve needle (3)" to --solenoid, with a valve needle--

On the title page, item (57) Abstract, line 3, delete "(23)"

On the title page, item (57) Abstract, line 4, change "member (4)," to --member,--

On the title page, item (57) Abstract, line 5, delete "(5)"

On the title page, item (57) Abstract, line 6, delete "(20)"

On the title page, item (57) Abstract, line 6, change "valve needle (3)." to --valve needle.--

On the title page, item (57) Abstract, line 7, delete "(35) (36)"

On the title page, item (57) Abstract, line 8, change "valve needle (3)." to -- valve needle.--

On the title page, item (57) Abstract, line 8, delete "(20)"

On the title page, item (57) Abstract, line 9, delete "(3)"

On the title page, item (57) Abstract, line 10, change "opening (34)," to --opening,--

On the title page, item (57) Abstract, line 11, change "valve needle (3)." to --valve needle.--

Column 1, line 3, change "BACKGROUND INFORMATION" to --FIELD OF THE INVENTION--

Column 1, line 4, change "The invention is based on" to --This invention relates to--

Column 1, lines 4-5, change "according to the definition of the species of the main claim." To --having a solenoid.--

Column 1, line 7, change "Patent DE-OS 33 14 899" to --Patent No. DE-OS 33 14 899--

Column 1, line 26, change "stop described." to --described stop.--

Column 1, line 36, change "Patent DE-OS 33 14 899" to --Patent No. DE-OS 33 14 899--

UNITED STATES PATENT AND TRADEMARK OFFICE

CERTIFICATE OF CORRECTION

PATENT NO. : 6,824,084 B2
APPLICATION NO. : 10/089584
DATED : November 30, 2004
INVENTOR(S) : Martin Maier et al.

It is certified that error appears in the above-identified patent and that said Letters Patent is hereby corrected as shown below:

Column 1, lines 54-55, change "injector housing with this guide unit surrounding" to --injector housing. This guide unit surrounds--

Column 1, line 55, change "but not being" to --but is not--

Column 1, line 61, change "Considering this disadvantage requires components" to --To counter this disadvantage requires that the components--

Column 1, line 62, change "that are manufactured" to --are manufactured--

Column 1, lines 62-63, change "these are characterized by" to --this requires--

Column 1, line 63, change "complex manufacture." to --complex manufacturing.--

Column 1, line 65, change "ADVANTAGES OF THE INVENTION" to --SUMMARY OF THE INVENTION--

Column 1, lines 66-67, delete "with the distinguishing characteristics of claim 1"

Column 2, line 4, change "that tilting is" to --that tilting may be--

Column 2, line 6, change "can be manufactured" to --may be manufactured--

Column 2, lines 11-13, delete "By the . . . are possible."

Column 2, line 14, change "is the wedge-shaped" to --may be the wedge-shaped--

Column 2, line 20, change "sealing seat, is" to -- sealing seat, may be --

Column 2, line 22, change "can always align" to --may always align--

Column 2, line 31, change "DRAWING" to --BRIEF DESCRIPTION OF THE DRAWINGS--

Column 2, lines 32-35, delete "Exemplary . . . description."

Column 2, line 38, change "present invention," to --present invention.--

Column 2, line 41, change "FIG.1, and" to --FIG.1.--

UNITED STATES PATENT AND TRADEMARK OFFICE

CERTIFICATE OF CORRECTION

PATENT NO. : 6,824,084 B2
APPLICATION NO. : 10/089584
DATED : November 30, 2004
INVENTOR(S) : Martin Maier et al.

It is certified that error appears in the above-identified patent and that said Letters Patent is hereby corrected as shown below:

Column 2, lines 45-46, change "DESCRIPTION OF THE EXEMPLARY EMBODIMENTS" to --DETAILED DESCRIPTION--

Column 2, line 48, change "is constructed" to --may be constructed--

Column 2, line 50, change "air mixture is" to --air mixture may be--

Column 2, line 51, change "Fuel injector 1 is" to --Fuel injector 1 may be--

Column 2, line 54, change "is composed of" to --may be composed of--

Column 2, line 62, change "Valve needle 3 is" to --Valve needle 3 may be--

Column 2, line 65, change "is symmetrical" to --may be symmetrical--

Column 2, line 66, change "Nozzle body 3 is sealed" to --Nozzle body 3 may be sealed--

Column 2, line 67, change "Solenoid 10 is encapsulated" to -- Solenoid 10 may be encapsulated--

Column 3, line 2, change "is touching" to --may be touching--

Column 3, line 3, change "are separated" to --may be separated--

Column 3, line 5, change "is excited" to --may be excited--

Column 3, line 7, change "is surrounded" to --may be surrounded--

Column 3, line 9, change "is guided" to --may be guided--

Column 3, line 10, change "is dish-shaped" to --may be dish-shaped--

Column 3, line 10, change "is used" to --may be used--

Column 3, line 11, change "is located" to --may be located--

Column 3, line 12, change "The armature is" --The armature may be--

Column 3, line 14, change "is connected" to --may be connected--

UNITED STATES PATENT AND TRADEMARK OFFICE

CERTIFICATE OF CORRECTION

PATENT NO. : 6,824,084 B2
APPLICATION NO. : 10/089584
DATED : November 30, 2004
INVENTOR(S) : Martin Maier et al.

It is certified that error appears in the above-identified patent and that said Letters Patent is hereby corrected as shown below:

Column 3, line 17, change “is pre-tensioned” to --may be pre-tensioned--

Column 3, line 18, change “is connected” to --may be connected--

Column 3, line 22, change “is larger than” to --may be larger than--

Column 3, lines 22-23, change “with the result that” to --which results in--

Column 3, line 23, change “has radial play” to --having a radial play--

Column 3, line 30, change “run in” to --run through--

Column 3, line 32, change “which is supplied” to -- which may be supplied--

Column 3, line 32, change “and is filtered” to --and may be filtered--

Column 3, line 34, change “is sealed of” to --may be sealed off--

Column 3, line 34, change “with respect to” to --from--

Column 3, line 35, change “with respect to” to --from--

Column 3, line 36, change “is pressed” to --may be pressed--

Column 3, line 38, change “is held in” to --may be held in--

Column 3, line 45, change “with it,” to --with it in the stroke direction.--

Column 3, lines 45-46, change “guide sleeve 36 being welded” to --Guide sleeve 36 may be welded--

Column 3, lines 46-47, change “valve needle 3, also in the stroke direction.” to --valve needle 3.--

Column 3, line 48, change “which is acted on” to --which may be acted on--

Column 3, lines 48-49, change “fuel is sprayed out” to --fuel may be sprayed out--

Column 3, line 50, change “after sufficient” to --after a sufficient--

UNITED STATES PATENT AND TRADEMARK OFFICE

CERTIFICATE OF CORRECTION

PATENT NO. : 6,824,084 B2
APPLICATION NO. : 10/089584
DATED : November 30, 2004
INVENTOR(S) : Martin Maier et al.

It is certified that error appears in the above-identified patent and that said Letters Patent is hereby corrected as shown below:

Column 3, line 51, change “magnetic field armature 20” to --magnetic field, the armature 20--

Column 3, line 52, change “internal pole 13 in reaction to” to --the internal pole is in response to--

Column 3, line 60, change “is situated” to --may be situated--

Column 3, line 61, change “is supported” to --may be supported--

Column 3, line 62, change “By central opening 34” to --The central opening 34--

Column 3, line 63, change “is selected” to --may be selected--

Column 3, line 64, change “protruding through” to --which protrudes through--

Column 3, line 65, change “radial play for armature 20 is ensured.” to --which ensures radial play for armature 20.”

Column 3, line 66, change “there is a” to --there may be a--

Column 4, lines 1-2, change “slight axial play is also present” to --a slight axial play may also be present--

Column 4, line 2, change “Armature 20 is” to --Armature 20 may be--

Column 4, line 3, change “fuel injector 1, external” to --fuel injector 1, thus external--

Column 4, line 4, change “embodiment being” to --embodiment may be--

Column 4, line 6, change “which is a” to --which may be a--

Column 4, line 8, change “Guide sleeves 35 and 36, for their part are guided” to --Guide sleeves 35 and 36 may be guided--

Column 4, lines 9-10, change “in each case with slight play.” to --and in each case with a slight play.--

Column 4, line 10, change “Guide sleeves 35 and 36 are” to --Guide sleeves 35 and 36 may be--

UNITED STATES PATENT AND TRADEMARK OFFICE

CERTIFICATE OF CORRECTION

PATENT NO. : 6,824,084 B2
APPLICATION NO. : 10/089584
DATED : November 30, 2004
INVENTOR(S) : Martin Maier et al.

It is certified that error appears in the above-identified patent and that said Letters Patent is hereby corrected as shown below:

Column 4, line 21, change “in consequence” to --as a result--

Column 4, line 26, change “In consequence,” to --As a result,--

Column 4, line 37, change “can also be” to --may also be--

Column 4, line 45, change “guide sleeves 35 and 35” to --guide sleeves 35 and 36--

Column 4, line 46, change “are formed in” to --may be formed in--

Column 4, line 51, change “can be formed as” to --are formed as--

Column 4, line 54, change “are keyed” to --may be keyed--

Column 4, line 55, change “is smaller” to --may be smaller--

Column 4, line 62, change “In consequence,” to --As a result,--

Column 4, line 65, change “can also be used” to --may also be used--

Signed and Sealed this

Twenty-fifth Day of July, 2006

JON W. DUDAS
*Director of the United States Patent and Trademark Office*